US006543953B1

(12) United States Patent
Kim

(10) Patent No.: US 6,543,953 B1
(45) Date of Patent: Apr. 8, 2003

(54) PORTABLE CASING FOR SOAP BAR

(76) Inventor: Sung-O Kim, 211-207 Shinbanpo Apt., 70 Chamwon-dong, Seocho-ku, Seoul 137-908 (KR)

( * ) Notice: Subject to any disclaimer, the term of this patent is extended or adjusted under 35 U.S.C. 154(b) by 0 days.

(21) Appl. No.: 10/032,101

(22) Filed: Dec. 31, 2001

(30) Foreign Application Priority Data

Nov. 24, 2001 (KR) ..... 2001-36279

(51) Int. Cl.[7] ..... A45D 40/04

(52) U.S. Cl. ..... 401/75; 401/68; 401/87; 401/88; 401/98; 401/116

(58) Field of Search ..... 401/75, 76, 77, 401/78, 68, 116, 87, 88, 98

(56) References Cited

U.S. PATENT DOCUMENTS 4,180,163 A * 12/1979 Grioni ..... 401/78 X
4,890,944 A * 1/1990 Cousins et al. ..... 401/75 X
5,813,421 A * 9/1998 Wang ..... 401/68 X
5,884,638 A * 3/1999 Ohba ..... 401/75 X
6,200,047 B1 * 3/2001 Holloway ..... 401/75
6,293,391 B1 9/2001 Kim

* cited by examiner

*Primary Examiner*—Gregory L. Huson
*Assistant Examiner*—Kathleen J. Prunner
(74) *Attorney, Agent, or Firm*—Smith Patent Office

(57) ABSTRACT

Disclosed is a portable casing for a soap bar which has a structure such as a lipstick container so that it receives a soap bar in such a fashion that the soap bar is normally in a retracted state within the casing while being extended from the casing by a desired length only when it is desired to be used, in order to allow the user to lather his desired body portion, thereby being convenient to use, carry, and store the soap bar. The portable soap bar casing includes a cylindrical casing body having a threaded hole, and a carrier member adapted to carry a soap bar and directly coupled to the threaded hole of the cylindrical casing body so as to directly receive a force from the cylindrical casing body for vertically moving the soap bar.

3 Claims, 4 Drawing Sheets

PORTABLE CASING FOR SOAP BAR

BACKGROUND OF THE INVENTION

1. Field of the Invention

The present invention relates to a portable casing for a bar of soap which has a structure such as a lipstick container so that it receives a soap bar in such a fashion that the soap bar is extended from and retracted into the casing in accordance with a rotating operation of the casing, thereby being convenient to use and carry the soap bar. More particularly, the present invention relates to a portable casing for a soap bar which has a structure such as a lipstick container so that it receives a soap bar in such a fashion that the soap bar is normally in a retracted state within the casing while being extended from the casing by a desired length only when it is desired to be used, in order to allow the user to lather his desired body portion, thereby being convenient to use, carry, and store the soap bar.

2. Description of the Related Art

Generally, when soap comes into contact with water, it is dissolved because it is soluble in water. In this case, the soap may be softened, and deformed.

In order to use soap for a prolonged period of time, therefore, it is necessary to prevent the soap from coming into contact with water when it is not used, for example, during its carriage or storage. It is also necessary to protect the soap from being damaged by an external impact.

Typically, soap products have a rectangular or oval shape while having a certain size and volume. Also, such soap products are generally received in a case or wrapped by a paper packing sheet, so that their volume is considerably increased. Due to such an increased volume, there is an inconvenience in carrying and using soap.

Furthermore, although soap has a size gradually reduced as it is used, the case thereof has a constant size. For this reason, the size-reduced soap is movable within the case, so that it may be damaged or broken when it is subjected to an external impact.

In order to wash a desired body portion with soap and water, the user must first lather his hands. For this reason, there is an inconvenience in using soap and waste of soap.

When the user desires to lather his particular body portion, for example, the armpit or neck, he must grasp the soap by his hand, and then rub the soap on the body portion. In this case, the soap is excessively consumed.

In order to solve such problems, a "portable casing for a soap bar" has been proposed which is disclosed in Korean Patent Application No. 99-55421 filed in the name of the present inventor.

The Korean Patent Application No. 99-55421 was filed on Dec. 7, 1999, and laid open on Mar. 6, 2000. U.S. Application corresponding to the Korean Patent Application has been allowed as a patent bearing U.S. Pat. No. 6,293,391.

The portable casing disclosed in the Korean Patent Application No. 99-55421 will be briefly described.

The portable casing includes a cylindrical casing body closed at the bottom thereof, a fixed base fixedly mounted to the bottom of the casing body and provided at an upper end thereof with a plurality of serrated elastic pieces, an elongated outer cylindrical member rotatably fitted in the casing body, and a lid separably fitted around the upper end of the outer cylindrical member. The portable casing also includes an intermediate cylindrical member fixedly fitted in the outer cylindrical member and provided at an inner surface thereof with spiral grooves, an inner cylindrical member rotatably received in the intermediate cylindrical member while having longitudinal guide slots formed at a cylindrical wall of the inner cylindrical member. The inner cylindrical member is also provided at the bottom thereof with a hole for receiving the serrated elastic pieces. A plurality of serrations are formed at the inner surface of the hole so that they are engaged with the serrations of the serrated elastic pieces. The portable casing further includes a carrier ring fitted in the inner cylindrical member and provided at its outer surface with guide protrusions respectively received in the spiral grooves via the guide slots, and a soap bar fitted in the carrier ring at its lower end. The carrier ring is vertically movable in accordance with a rotating operation of the casing body, so that the soap bar fixed to the carrier ring is vertically movable.

When the user rotates the casing body with respect to the outer cylindrical member after separating the lid from the outer cylindrical member, the fixed base fixedly mounted to the casing body is rotated, so that the inner cylindrical member is rotated because it is coupled with the fixed base via the serrations. In accordance with the rotation of the inner cylindrical member, the carrier ring is rotated because its guide protrusions are engaged with respective guide slots of the inner cylindrical member.

Simultaneously with the rotation, the carrier ring is upwardly moved because its guide protrusions are respectively engaged with the spiral grooves of the intermediate cylindrical member via the guide slots.

In accordance with the upward movement of the carrier ring, the soap bar fixed to the carrier ring is outwardly protruded from the outer cylindrical member. Thus, the user can outwardly protrude the soap bar by a desired length. In this state, the user can lather his desired body portion using the protruded soap bar.

When the user rotates the casing body in the reverse direction after using the soap bar, a reverse operation of the above described operation is carried out, thereby causing the soap bar to be retracted into the outer cylindrical member. After the soap bar is completely retracted, the user fits the lid around the upper end of the outer cylindrical member.

In this state, the user can put the portable casing in a handbag or pocket to carry it, like as lipsticks. Otherwise, the portable casing may be kept at a desired place.

That is, the above mentioned portable casing disclosed in Korean Patent Application No. 99-55421 has a configuration, in which as the casing body or outer cylindrical body rotates, the carrier ring is vertically moved while being guided by the spiral grooves of the intermediate cylindrical member and the guide slots of the inner cylindrical member, thereby causing the soap bar fixed to the carrier ring to be vertically moved for its protrusion or retraction.

However, this portable casing has disadvantages in that it may operate unstably while requiring a great rotating force because the rotating force applied to the casing body is indirectly transmitted to the carrier ring via the fixed base, serrations, and inner cylindrical member. As described above, the spiral grooves serving to convert the rotating force into a vertical moving force for the carrier ring are formed at the intermediate cylindrical member arranged above the casing body.

Furthermore, when an excessive force is applied to the serrations of the fixed base and inner cylindrical member serving as power transmission means, those serrations may be disengaged from each other. Moreover, the portable casing uses a large number of elements, thereby causing a difficulty in the manufacturing process, an increase in the manufacturing costs, and a degradation in quality.

SUMMARY OF THE INVENTION

Therefore, the present invention has been made in view of the above mentioned problems, and an object of the invention is to provide a portable casing for a soap bar which is configured to directly transmit a rotating force, applied to a casing body, to a carrier ring carrying the soap bar, thereby being capable of achieving a reliable operation with a reduced force to easily extend and retract the soap bar.

Another object of the invention is to provide a portable casing for a soap bar which has a reduced number of constituting elements, thereby being capable of reducing the manufacturing costs while achieving an improvement in quality.

In accordance with the present invention, these objects are accomplished by providing a portable casing for a soap bar comprising a cylindrical casing body having a threaded hole, and a carrier member adapted to carry a soap bar and directly coupled to the threaded hole of the cylindrical casing body so as to directly receive a force from the cylindrical casing body for vertically moving the soap bar.

Since the rotating force from the cylindrical casing body is directly transmitted to the carrier member, the operation of the portable soap bar casing is reliable. The portable soap bar casing can also be constructed using a reduced number of constituting elements. Accordingly, it is possible to achieve a reduction in manufacturing costs and an improvement in quality.

Since the user can protrude the soap bar by a desired length, and lather his desired body portion using the protruded soap bar, it is convenient to use the portable soap bar casing. It is also possible to prevent the soap bar from being damaged.

BRIEF DESCRIPTION OF THE DRAWINGS

The above and other objects, features and other advantages of the present invention will be more clearly understood from the following detailed description taken in conjunction with the drawings, in which.

DESCRIPTION OF THE PREFERRED EMBODIMENTS

Now, the present invention will be described in detail with reference to the annexed drawings.

Figure 1:
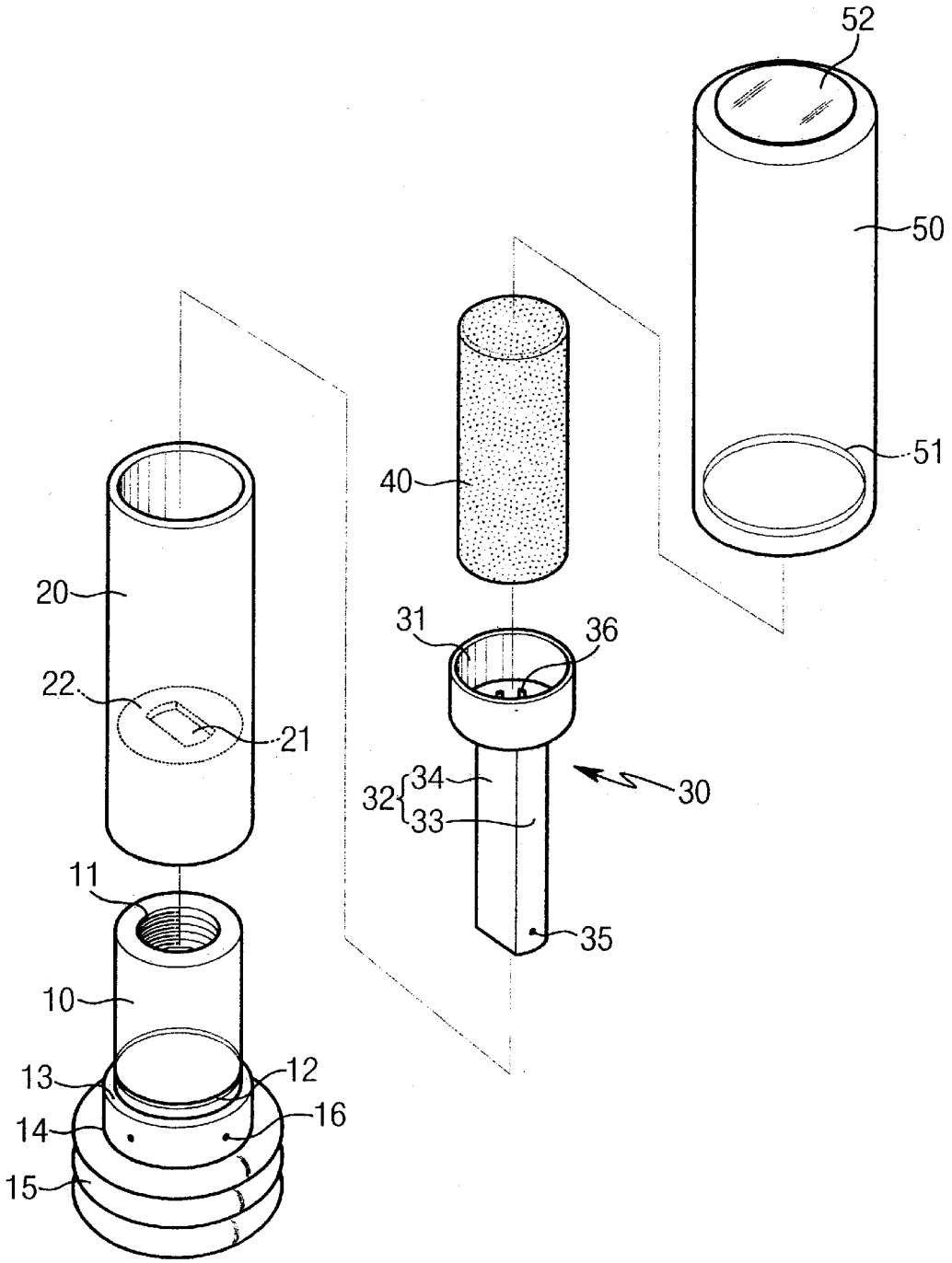
FIG. 1 is an exploded perspective view illustrating a portable casing for a soap bar according to the present invention.
Figure 2:
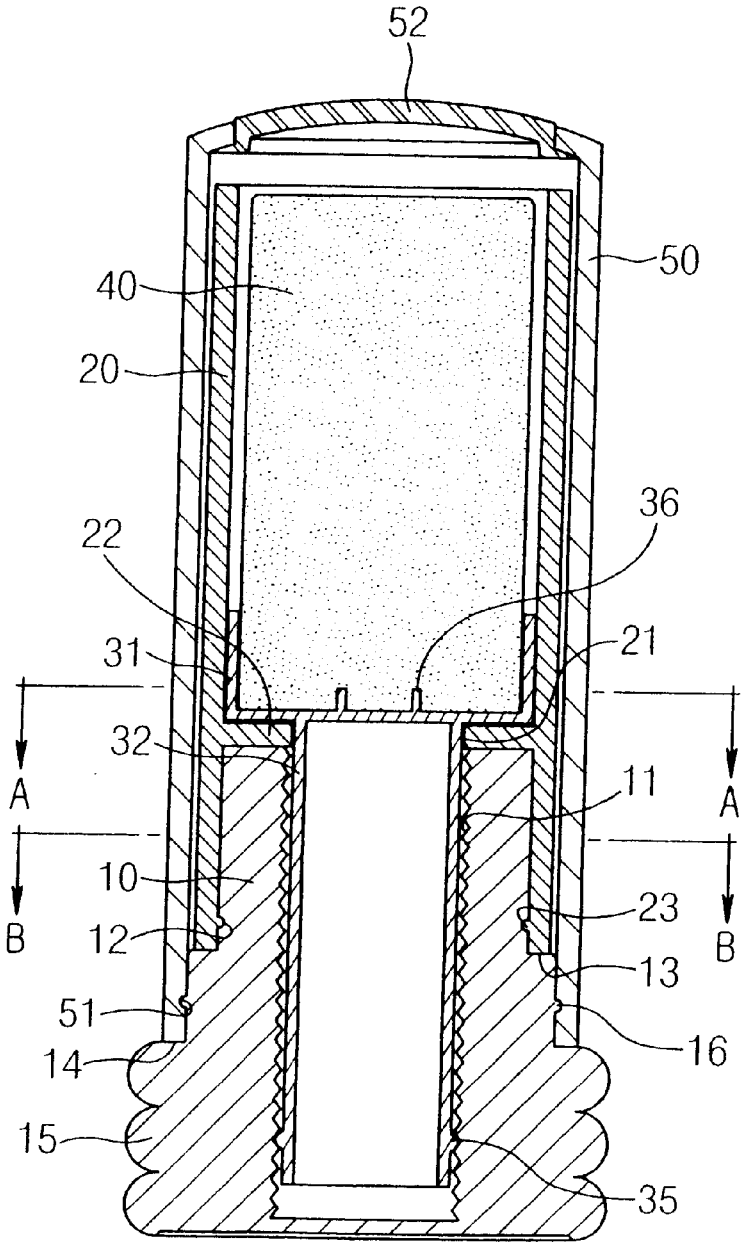
FIG. 2 is an assembled sectional view illustrating the portable soap bar casing.
Figure 3:
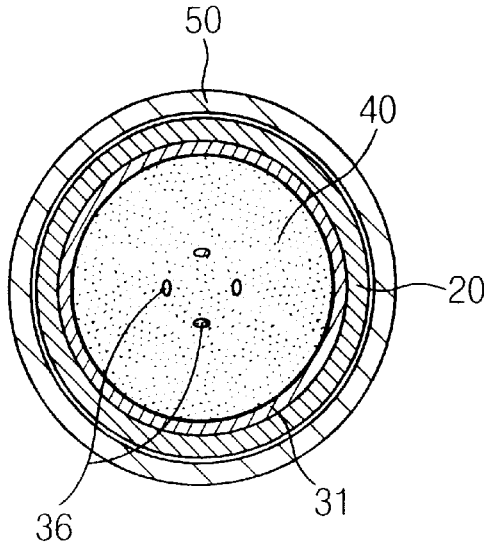
FIG. 3 is a cross-sectional view taken along the line A—A of FIG. 2.
Figure 4:
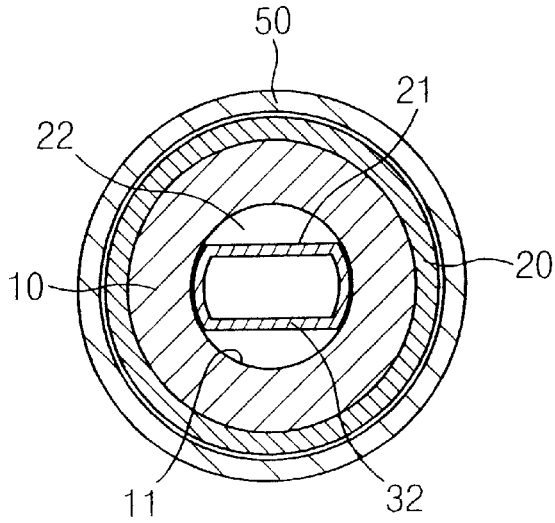
FIG. 4 is a cross-sectional view taken along the line B—B of FIG. 2.
Figure 5:
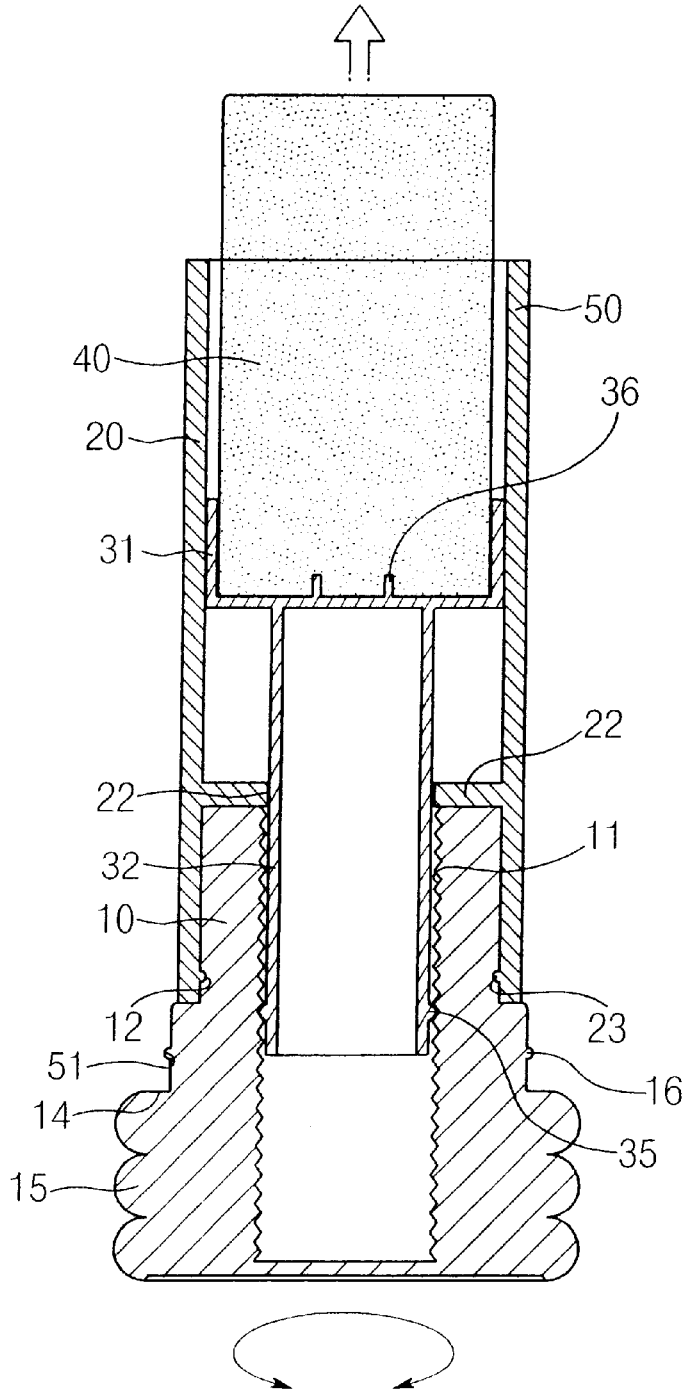
FIG. 5 is a sectional view illustrating the operation of the portable soap bar casing.

FIG. 1 is an exploded perspective view illustrating a portable casing for a soap bar according to the present invention. FIG. 2 is an assembled sectional view illustrating the portable casing. FIGS. 3 and 4 are assembled cross-sectional views illustrating an essential part of the portable casing, respectively.

As shown in FIGS. 1 to 4, the portable casing includes a cylindrical casing body 10 closed at the bottom thereof while being open at the top thereof. A cylindrical member 20 is rotatably fitted around an upper portion of the cylindrical casing body 10. The casing body 10 has a threaded hole 11 extending downwardly from the top of the casing body 10 by a desired length. The cylindrical member 20 is provided with a support 22 arranged in the interior of the cylindrical member 20 while being integral with the cylindrical member 20. The support 22 has a rectangular guide hole 21. A carrier member 30 is received in the cylindrical member 20 so that it is seated on the support 22. The carrier member 30 is provided at an upper portion thereof with a carrier portion 31 seated on the support 22, and at a lower portion thereof with a coupling portion 32 extending downwardly through the guide hole 21 of the support 22. The coupling portion 32 of the carrier member 30 is threadedly coupled with the threaded hole 11 of the casing body 10. A soap bar 40 is fitted in the carrier portion 31 of the carrier member 30 at its lower end. A lid 50 is separably coupled to the cylindrical casing body 10.

As described above, the cylindrical casing body 10, which is closed at the bottom thereof, has the threaded hole 11. The cylindrical casing body 10 has a stepped structure including three portions of different diameters, that is, an upper portion, an intermediate portion having a diameter larger than that of the upper portion, and a lower portion having a diameter larger than that of the intermediate portion. The lower portion of the cylindrical casing body 10 functions as a knob 15. Steps 13 and 14 are defined between the upper and intermediate portions and between the intermediate and lower portions, respectively. The upper portion of the cylindrical casing body 10 is provided at its outer surface with an annular guide groove 12 arranged near the step 13. The intermediate portion of the cylindrical casing body 10 is provided at its outer surface with a plurality of annular protrusions 16.

As described above, the cylindrical member 20 includes the support 22 having the rectangular guide hole 21. The cylindrical member 20 is also provided at its inner surface with a plurality of guide protrusions 23 arranged near the lower end of the cylindrical member 20 and adapted to be fitted in the guide groove 12 of the cylindrical casing body 10.

The rectangular guide hole 21 has straight longitudinal edges, and arc-shaped lateral edges.

The carrier portion 31 provided at the upper portion of the carrier member 30 has a cylindrical structure, whereas the coupling portion 32 provided at the lower portion of the carrier member 30 has a hollow rectangular rod structure.

The carrier portion 31 has a plurality of fixing protrusions 36 upwardly protruded from the bottom surface of the carrier portion 31 and adapted to prevent the soap bar 40 fitted in the carrier portion from being moved. The cross-sectional shape of the coupling portion 32 corresponds to the shape of the guide hole 21. That is, the coupling portion 32 has arc-shaped surfaces 33 corresponding to the arc-shaped lateral edges of the guide hole 21, and flat surfaces 34 corresponding to the straight longitudinal edges of the guide hole 21. Guide protrusions 35 are formed at the arc-shaped surfaces 33 of the coupling portion 32. The guide protrusions 35 are engaged with the threaded hole 11 of the cylindrical casing body 10 so as to threadedly couple the carrier member 30 to the cylindrical casing body 10.

The soap bar 40 has a diameter smaller than the inner diameter of the cylindrical member 20, and is seated on the bottom of the carrier portion 31 of the carrier member 20.

The lid 50 is fitted around the intermediate portion of the cylindrical casing body 10 while surrounding the cylindrical member 20. The guide groove 51 formed at the lower portion of the lid 50 is engaged with the guide protrusions 16 of the cylindrical casing body 10 so as to couple the lid 50 to the cylindrical casing body 10.

A window member 52 is provided at the upper end of the lid 50 in order to allow the user to identify the consumed amount of the soap bar 40, and the level of the soap bar 40 in the cylindrical member 20. Preferably, the window member 52 is made of a transparent synthetic resin.

In an assembling process, the cylindrical member 20 is first fitted around the upper portion of the cylindrical casing body 10.

At this time, the support 22 and lower end of the cylindrical member 20 come into contact with the upper end and upper step 13 of the cylindrical casing body 10, respectively. Simultaneously, the guide protrusions 23 provided at the inner surface of the cylindrical member 20 are elastically fitted in the guide groove 12 of the cylindrical casing body 10. Thus, the cylindrical member 20 is coupled to the cylindrical casing body 10 so that they are freely rotatable with respect to each other.

Thereafter, the carrier member 30 is inserted into the cylindrical member 20 in such a fashion that the coupling portion 32 thereof is inserted through the guide hole 21 of the support 22 until the carrier portion 31 of the carrier member 30 comes into contact with the support 22. Since the coupling portion 32 of the carrier member 30 has an elasticity, the insertion of the carrier member 30 can be achieved by simply applying a downward force to the carrier member 30 until the carrier portion 31 comes into contact with the support 22.

In a state in which the carrier member 30 is completely inserted into the cylindrical member 20, the guide protrusions 35 provided at the arc-shaped surface 33 of the carrier member 30 are engaged with the threaded hole 11 of the cylindrical casing body 10 at the lower end of the threaded hole 11. In this state, when the cylindrical casing body 10 is rotated with respect to the cylindrical member 20, the rotating force thereof is directly transmitted to the carrier member 20. Since both the guide hole 21 of the cylindrical member 20 and the coupling portion 32 of the carrier member 20 have a rectangular shape, the carrier member 20 is vertically moved by the rotating force without being rotated.

In order to allow the carrier member 20 to move vertically without rotating, the guide hole 21 and coupling portion 32 may have various shapes other than the rectangular shape, for example, a triangular shape, a pentagonal shape, or a hexagonal shape.

After completion of the assembling of the carrier member 20, the soap bar 40 is fitted in the carrier portion 31 of the carrier member 20 at its lower end.

When the soap bar 40 is seated on the bottom of the carrier portion 31, the fixing protrusions 36 of the carrier portion 31 are penetrated into the soap bar 40, thereby preventing the soap bar 40 from being moved.

Finally, the lid 50 is fitted around the intermediate portion of the cylindrical casing body 10 in such a fashion that it surrounds the cylindrical member 20. At this time, the guide protrusions 16 of the cylindrical casing body 10 are engaged with the guide groove 51 of the lid 50. Also, the lower end of the lid 50 is supported by the lower step 14 of the cylindrical casing body 10. Accordingly, the lid 50 is maintained in its coupled state unless the user applies a force to the lid 50 in order to separate the lid 50 from the cylindrical casing body 10. In the coupled state of the lid 50, the user can observe the soap bar 50 through the window member 52.

Now, the operation and effect of the portable soap bar casing having the above described construction will be described.

In the state in which the lid 50 is coupled to the cylindrical casing body 10, the user can put the portable soap bar casing into a pocket or handbag to carry it, or store it at a desired place.

When the user desires to use the soap bar, he separates the lid 50 from the cylindrical casing body 10, and then rotates the knob 15 of the cylindrical casing body 10 by one hand while grasping the cylindrical member 20 by the other hand.

By the rotation of the knob 15, the threaded hole 11 is rotated, thereby causing the carrier member 30 to be upwardly moved in accordance with a movement of the guide protrusions 35 along the threads of the threaded hole 11.

At this time, the carrier member 30 moves only in the vertical direction without rotating because the coupling portion 32 thereof is fitted in the rectangular guide hole 21 of the cylindrical member 20.

As the carrier member 30 moves upwardly in accordance with the rotation of the cylindrical casing body 10, the soap bar 40 seated on the carrier portion 31 of the carrier member 30 is outwardly protruded from the cylindrical member 20.

After protruding the soap bar 40 by a desired length, the user can lather his desired body portion using the protruded soap bar 40. After washing the desired body portion with soap and water, the user rotates the knob 15 of the cylindrical casing body 10 in the reverse direction.

Accordingly, a reverse operation of the above described operation is carried out, thereby causing the soap bar 40 to be retracted into the interior of the cylindrical member 20. After the soap bar is completely retracted, the user fits the lid around the intermediate portion of the cylindrical casing body 10. In this state, the user can put the portable soap bar casing in a handbag or pocket to carry it. Otherwise, the portable casing may be kept at a desired place.

Since the cylindrical casing body 10 and the cylindrical member 20 are rotatable relative to each other, it is possible to extend and retract the soap bar 40 by rotating any one of the rotating elements 10 and 20.

As apparent from the above description, the present invention provides a portable casing for a soap bar which has a structure such as a lipstick container so that it receives a soap bar in such a fashion that the soap bar is normally in a retracted state within the casing while being extended from the casing by a desired length only when it is desired to be used, in order to allow the user to lather his desired body portion, thereby being convenient to use, carry, and store the soap bar.

The portable soap bar casing includes a cylindrical casing body having a threaded hole, and a carrier member adapted to carry a soap bar and directly coupled to the threaded hole of the cylindrical casing body so as to directly receive a force from the cylindrical casing body for vertically moving the soap bar. Accordingly, the operation of the portable soap bar casing is reliable.

Since the portable soap bar casing of the present invention uses a reduced number of constituting elements, it achieves a reduction in manufacturing costs and an improvement in quality.

Since the user can protrude the soap bar by a desired length, and lather his desired body portion using the protruded soap bar, it is convenient to use the portable soap bar casing. It is also possible to prevent the soap bar from being damaged.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A portable casing for a soap bar comprising:

a cylindrical casing body closed at the bottom thereof while being open at the top thereof, the casing body having a threaded hole extending downwardly from the top of the casing body by a desired length;

a cylindrical member rotatably fitted around an upper portion of the cylindrical casing body, and provided with a support arranged in the interior of the cylindrical member while being integral with the cylindrical member, the support having a guide hole;

a carrier member received in the cylindrical member so that it is seated on the support, the carrier member being provided at an upper portion thereof with a carrier portion seated on the support, and at a lower portion thereof with a coupling portion extending downwardly through the guide hole of the support, the coupling portion being threadedly coupled with the threaded hole of the casing body;

a soap bar fitted in the carrier portion of the carrier member at a lower end thereof; and a lid separably coupled to the cylindrical casing body while surrounding the cylindrical member.

2. The portable casing according to claim 1, wherein:

the guide hole of the cylindrical member has a rectangular structure so that it has straight longitudinal edges, and arc-shaped lateral edges;

the coupling portion of the carrier member has a cross-sectional structure identical to the rectangular structure of the guide hole so that it has arc-shaped surfaces corresponding to the arc-shaped lateral edges of the guide hole, and flat surfaces corresponding to the straight longitudinal edges of the guide hole; and the coupling portion of the carrier member has guide protrusions respectively formed at the arc-shaped surfaces thereof and engaged with the threaded hole of the cylindrical casing body to threadedly couple the carrier member to the cylindrical casing body.

3. The portable casing according to claim 1, further comprising a window member provided at an upper end of the lid and adapted to allow a user to identify a consumed amount of the soap bar, and a level of the soap bar in the cylindrical member.

* * * * *